US009031242B2

(12) United States Patent
Edwards et al.

(10) Patent No.: US 9,031,242 B2
(45) Date of Patent: May 12, 2015

(54) SIMULATED SURROUND SOUND HEARING AID FITTING SYSTEM

(75) Inventors: Brent Edwards, San Francisco, CA (US); William S. Woods, Berkeley, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1017 days.

(21) Appl. No.: 11/935,935

(22) Filed: Nov. 6, 2007

(65) Prior Publication Data

US 2009/0116657 A1 May 7, 2009

(51) Int. Cl.

| | |
|---|---|
| ***H04R 5/00*** | (2006.01) |
| ***H04R 25/00*** | (2006.01) |
| ***H04R 29/00*** | (2006.01) |
| ***H04R 5/02*** | (2006.01) |
| *H04S 1/00* | (2006.01) |

(52) U.S. Cl.

CPC ..... *H04R 25/552* (2013.01); *H04R 25/70* (2013.01); *H04R 25/554* (2013.01); *H04S 1/005* (2013.01); *H04S 2420/01* (2013.01)

(58) Field of Classification Search

USPC ..... 381/23.1, 60, 61, 63, 21, 22, 23, 310, 381/17–19

See application file for complete search history.

(56) References Cited

U.S. PATENT DOCUMENTS

| | | | | |
|---|---|---|---|---|
| 4,406,001 | A | 9/1983 | Klasco et al. | |
| 4,996,712 | A | 2/1991 | Laurence et al. | |
| 5,785,661 | A | 7/1998 | Shennib | |
| 5,825,894 | A * | 10/1998 | Shennib | 381/60 |
| 6,405,163 | B1 | 6/2002 | Laroche | |
| 7,280,664 | B2 * | 10/2007 | Fosgate et al. | 381/19 |
| 7,330,556 | B2 | 2/2008 | Kates | |
| 7,340,062 | B2 * | 3/2008 | Revit et al. | 381/60 |
| 7,409,068 | B2 | 8/2008 | Ryan et al. | |
| 2001/0040969 | A1 | 11/2001 | Revit et al. | |
| 2004/0190734 | A1 | 9/2004 | Kates | |
| 2005/0135643 | A1 * | 6/2005 | Lee et al. | 381/309 |
| 2006/0034361 | A1 | 2/2006 | Choi | |

(Continued)

FOREIGN PATENT DOCUMENTS

| | | | |
|---|---|---|---|
| DE | 102006047983 | A1 | 4/2008 |
| DE | 102006047986 | A1 | 4/2008 |

(Continued)

OTHER PUBLICATIONS

"European Application Serial No. 08253607.9, Search Report mailed Aug. 11, 2009", 9 pgs.

(Continued)

*Primary Examiner* — Vivian Chin
*Assistant Examiner* — David Ton
(74) *Attorney, Agent, or Firm* — Schwegman Lundberg & Woessner, P.A.

(57) ABSTRACT

This application relates to a system for fitting a hearing aid by testing the hearing aid patient with a three-dimensional sound field having one or more localized sound sources. In one embodiment, a signal processing system employing head-related transfer functions is used to produce audio signals that simulate a three-dimensional sound field when a sound source driven by such audio signals is coupled directly to one or both ears. By transmitting the audio signals produced by the signal processing system to the hearing aid by means of a wired or wireless connection, the hearing aid itself may be used as the sound source.

41 Claims, 5 Drawing Sheets

(56) References Cited

U.S. PATENT DOCUMENTS

| | | | | |
|---|---|---|---|---|
| 2006/0050909 | A1* | 3/2006 | Kim et al. | 381/309 |
| 2006/0083394 | A1* | 4/2006 | McGrath | 381/309 |
| 2007/0076902 | A1 | 4/2007 | Master | |
| 2007/0297626 | A1 | 12/2007 | Revit et al. | |
| 2009/0043591 | A1* | 2/2009 | Breebaart et al. | 704/500 |
| 2010/0040135 | A1* | 2/2010 | Yoon et al. | 375/240.01 |
| 2011/0286618 | A1 | 11/2011 | Vandali et al. | |
| 2013/0108096 | A1 | 5/2013 | Fitz | |
| 2013/0148813 | A1 | 6/2013 | Strelcyk et al. | |

FOREIGN PATENT DOCUMENTS

| | | | |
|---|---|---|---|
| EP | 1531650 | A2 | 5/2005 |
| EP | 1655998 | A2 | 5/2006 |
| EP | 1796427 | A1 | 6/2007 |
| EP | 1895515 | A1 | 3/2008 |
| EP | 1236377 | B1 | 11/2011 |
| WO | WO-0124577 | A1 | 4/2001 |
| WO | WO-0176321 | A1 | 10/2001 |
| WO | WO-2007041231 | A2 | 4/2007 |
| WO | WO 2007096808 | A1 * | 8/2007 |
| WO | WO-2007106553 | A1 | 9/2007 |

OTHER PUBLICATIONS

"European Application Serial No. 09161628.4, Extended European Search Report mailed Aug. 5, 2009", 4 pgs.

Stone, Michael A., "Effects of spectro-temporal modulation changes produced by multi-channel compression on intelligibility in a competing-speech task", *J. Acoust. Soc. Am.* vol. 123, Issue 2, (Feb. 2008), 1063-1076.

"European Application Serial No. 08253607.9, Office Action Response Filed Sep. 22, 2010", 12 pgs.

"European Application Serial No. 08253607.9, Office Action mailed Mr. 19, 2010", 1 pg.

"European Application Serial No. 09161628.4, Response filed Feb. 11, 2010 to European Search Report mailed Aug. 5, 2009", 3 pgs.

"European Application Serial No. 08253607.9; Office Action mailed May 9, 2011", 9 Pgs.

"European Application Serial No. 09161628.4, Communication of a Notice of Opposition mailed May 23, 2011", 15 pgs.

"European Application Serial No. 09161628.4, European Search Report mailed Jul. 29, 2009", 3 pgs.

"U.S. Appl. No. 12/474,881, Response filed Dec. 30, 2011 to Restriction Requirement mailed Nov. 30, 2011", 7 pgs.

"U.S. Appl. No. 12/474,881, Restriction Requirement mailed Nov. 30, 2011", 7 pgs.

"European Application Serial No. 08253607.9, Office Action Response filed Nov. 16, 2011", 11 pgs.

"U.S. Appl. No. 12/474,881, Non Final Office Action Mailed Jan. 13, 2012", 11 pgs.

U.S. Appl. No. 12/474,881, Final Office Action mailed Jun. 21, 2012, 9 pgs.

U.S. Appl. No. 12/474,881, Response filed Jun. 13, 2012 to Non Final Office Action mailed Jan. 13, 2012, 8 pgs.

U.S. Appl. No. 12/474,881, Response filed Dec. 20, 2012 to Final Office Action mailed Jun. 21, 2012, 6 pgs.

"U.S. Appl. No. 12/474,881, Notice of Allowance mailed Sep. 4, 2013", 9 pgs.

"U.S. Appl. No. 12/474,881, Notice of Allowance mailed Nov. 15, 2013", 7 pgs.

"European Application Serial No. 09161628.4, Communication of Notice of Opposition mailed May 23, 2011", 15 pgs.

"European Application Serial No. 09161628.4, Letter from the Opponent mailed Sep. 16, 2013", 6 pgs.

"European Application Serial No. 09161628.4, Response filed Jan. 6, 2012 to Notice of Opposition mailed Jun. 21, 2011", 14 pgs.

"European Application Serial No. 09161628.4, Response filed Sep. 16, 2013 to Summons to Attend Oral Proceedings mailed Mar. 7, 2013", 48 pgs.

"European Application Serial No. 09161628.4, Summons to Attend Oral Proceedings mailed Mar. 7, 2013", 13 pgs.

* cited by examiner

SIMULATED SURROUND SOUND HEARING AID FITTING SYSTEM

FIELD OF THE INVENTION

This patent application pertains to devices and methods for treating hearing disorders and, in particular, to a simulated surround sound hearing aid fitting system for electronic hearing aids.

BACKGROUND

Hearing aids are electronic instruments worn in or around the ear that compensate for hearing losses by amplifying and processing sound. The electronic circuitry of the device is contained within a housing that is commonly either placed in the external ear canal or behind the ear. Transducers for converting sound to an electrical signal and vice-versa may be integrated into the housing or external to it.

Whether due to a conduction deficit or sensorineural damage, hearing loss in most patients occurs non-uniformly over the audio frequency range, most commonly at high frequencies. Hearing aids may be designed to compensate for such hearing deficits by amplifying received sound in a frequency-specific manner, thus acting as a kind of acoustic equalizer that compensates for the abnormal frequency response of the impaired ear. Adjusting a hearing aid's frequency specific amplification characteristics to achieve a desired level of compensation for an individual patient is referred to as fitting the hearing aid. One common way of fitting a hearing aid is to measure hearing loss, apply a fitting algorithm, and fine-tune the hearing aid parameters.

Hearing loss is measured by testing the patient with a series of audio tones at different frequencies. The level of each tone is adjusted to a threshold level at which it is barely perceived by the patient, and the audiogram or hearing deficit at each tested frequency is quantified as the elevation of the patient's threshold above the level defined as normal by ANSI standards. For example, if the normal hearing threshold for a particular frequency is 4 dB SPL, and the patient's hearing threshold is 47 dB SPL, the patient is said to have 43 dB of hearing loss at that frequency.

Compensation is then initially provided through a fitting algorithm. This is a formula which takes the patient's audiogram data as input to the formula and calculates gain and compression ratio at each frequency. A commonly used fitting algorithm is the NAL_NL1 fitting formula derived by the National Acoustic Laboratories in Australia and the DSL-i/o fitting formula derived at the University of Western Ontario. The audiogram provides only a simple characterization of the impairment to someone's ear and does not differentiate between different physiological mechanisms of loss such as inner hair cell damage, as opposed to, outer hair cell damage. Patients with the same audiogram often show considerable individual differences, with differences in their speech understanding ability, loudness perception, and hearing aid preference. Because of this, the initial fit based on the audiogram is not usually the best or final fit of the hearing aid parameters to the patient. In order to address individual differences, fine-tuning of the hearing aid parameters is conducted by the audiologists.

Typically, the patient will wear a hearing aid for one-to-three weeks and return to the audiologist's office, whereupon the audiologist will make modifications to the hearing aid parameters based on the experience that the patient had with real-world sound in different environments, such as in a restaurant, in their kitchen or on a bus. For example, a patient may say that they like to listen to the radio while washing dishes, but with the hearing aid loud enough to hear the radio, the sound of the silverware hitting the dishes is sharp and unpleasant. The audiologist might make adjustments to the hearing aid by reducing the gain and adjusting the compression ratio in the high frequency region to preserve the listening experience of the radio while making the silverware sound more pleasant. Whether these adjustments solve the problem for the patient, however, will only be determined later when the patient experiences those problem sounds in those problem environments again. The patient may have to return to the audiologist's office several times for adjustments to their hearing aid until all sounds are set appropriately for their impairment and preference.

This process could be improved if the audiologist were able to create a real-world experience so that the patient could instantly tell the audiologist if the adjustments that are made are successful or not. In the above example, if the audiologist could present the real-world sounds of a radio and a fork on a plate while washing dishes to the patient, the audiologist could make as many adjustments as necessary to optimize the hearing aid setting for that sound during a single office visit, rather than having to make an adjustment, have the patient go back home and experience the new setting, then come back to the office if the experience wasn't optimal.

To address this problem, some hearing aid manufacturers have provided realistic sounds in their fitting software that use a 5.1 surround speaker setup. The surround sound is important because the spatial location can affect the sound quality and speech intelligibility of what they hear. Without it, the fine-tuning adjustments made in the audiologist's office may not be optimal for the real world in which the patient experiences problems. Also, natural reverberation, a problem sound for hearing aid wearers, is better reproduced with surround speakers than with a typical stereo front-placement speaker setup. Unfortunately, most audiologists' offices do not have 5.1 surround speaker setups, either due to cost, space, lack of supportive driving hardware, unfamiliarity with setup and calibration, or multiples of the above.

Spatial hearing is an important ability in normal hearing individuals, with echo suppression, localization, and spatial release from masking being some of the benefits provided. Audiologists would like to be able to demonstrate that hearing aids provide these benefits to their patients, and this can be done with a surround speaker setup but not the typical two-speaker stereo setup that exists in most clinics. Any hearing aid algorithms that were developed for these spatial percepts will be difficult to demonstrate in the audiologist's office.

SUMMARY

This application provide methods and apparatus for fitting and fine-tuning a hearing aid by presenting to the hearing aid patient a spatial sound field having one or more localized sound sources without the need for a surround speaker setup. The parameters of the hearing aid may be adjusted in a manner that allows the patient to properly perceive the sound field, localize the sound source(s), and gain any available benefit from spatial perception. In one embodiment, a signal processing system employing head-related transfer functions ("HRTFs") is used to produce audio signals that simulate a three-dimensional sound field when a sound source producing such audio signals is coupled directly to one or both ears. By transmitting the audio signals produced by the signal processing system to the hearing aid, the hearing aid itself may be used as the sound source without requiring any surround speaker setup.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

Figure 1:
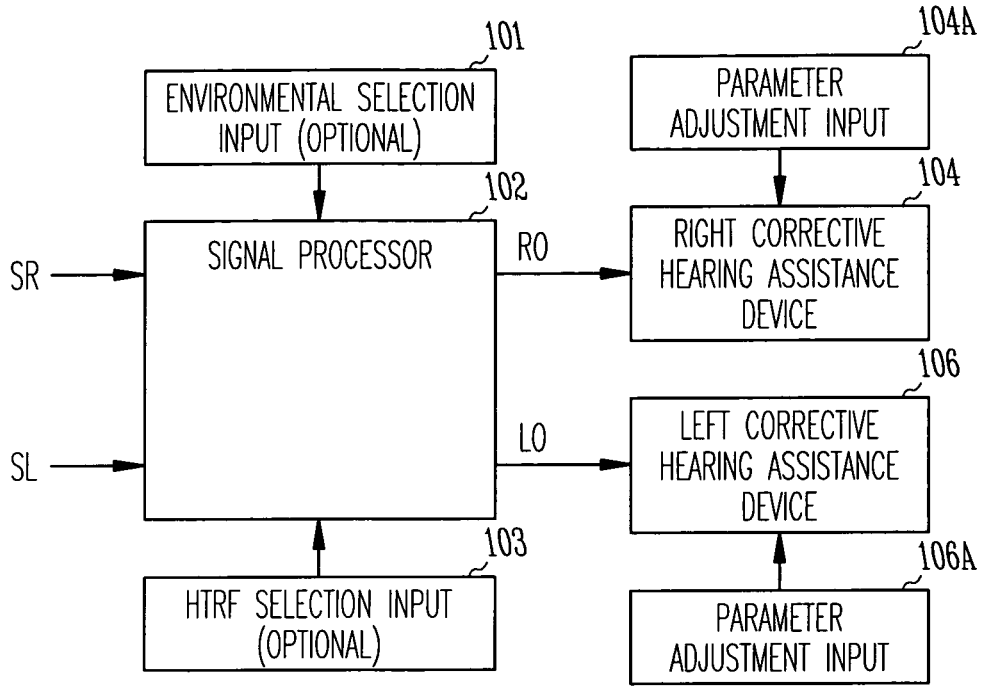
FIG. 1 illustrates a basic system that includes a signal processor for processing left and right stereo signals in order to produce left and right simulated surround sound output signals that can be used to drive left and right corrective hearing assistance devices according to one embodiment of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

As part of the hearing aid fitting process, audiologists often present real-world types of sounds to the listener to determine if the settings are appropriate for such sounds and to adjust hearing aid parameters in accordance with the subjective preferences expressed by the user. Real-world types of sounds also allow the audiologist to demonstrate particular features of the hearing aid and to set realistic expectations for the hearing aid wearer. Typically, however, equipment for presenting such sounds consists only of two speakers attached to a computer. Multi-channel surround sound systems exist to play sounds from an array of speakers that number more than two (e.g., so-called 5.1 and 6.1 systems with speakers located in front of, to the sides of, and behind the listener). Such surround sound systems are capable of producing complex sound fields that incorporate information relating to the spatial location of different sound sources around the listener. Most audiologists, however, do not have this kind of hardware in their clinic or office. Audiologists are also often limited in the space that they have to locate speakers and often only have a desktop for the speakers. Also, the realistic quality of sound produced by a surround sound system with multiple speakers is highly dependent upon the acoustic environment in which the speakers are placed.

Described herein is a hearing aid fitting system in which audio is transmitted directly into hearing aid rather than having the hearing aid pick up sound produced by external speakers. Audio signals can be transmitted to the hearing aid by a wire connected to the direct audio input (DAI) of the hearing aid or can be transmitted wirelessly to a receiver attached to the hearing aid DAI or to a receiver embedded in the hearing aid. Only a stereo (2-channel) signal is presented to the listener. In the case where the user wears two hearing aids, each hearing aid may receive one of the stereo signals. For a user who only wears one hearing aid, one stereo signal may be fed to the hearing aid, and the other stereo signal may be fed to a headphone or other device that acoustically couples directly to the ear. As described below, the stereo signals may be generated using signal processing algorithms in order to simulate a complex sound field such as may be produced by one or more sound sources located at different points around the listener.

Localization of Sound by the Human Ear

Although the means by which the human auditory system localizes sound sources in the environment is not completely understood, a number of different physical and physiological phenomena are known to be involved. The fact that humans have two ears on opposite sides of the head may cause binaural hearing differences that can be used by the brain to laterally locate a sound source. For example, if a sound source is located to the right of a listener's forward direction, the left ear is in the acoustic shadow cast by the listener's head. This causes the signal in the right ear to be more intense than the signal in the left ear which may serve as a clue that the sound source is located on the right. The difference between intensities in the left and right ears is known as the interaural level difference (ILD). Due to diffraction effects that reduce the acoustic shadow of the head, the ILD is small for frequencies below about 3000 Hz. At higher frequencies, however, the ILD is a significant source of information for sound localization. Another binaural hearing difference is the difference in the time it takes for sound waves emanating from a single source to reach the two ears. This time difference, referred to as the interaural time difference (ITD) and equivalent to a phase difference in the frequency domain, can be used by the auditory system to laterally locate a sound source if the wavelength of the sound wave is long compared with the difference in distance from each ear to the sound source. It has been found that the auditory system can most effectively use the ITD to locate pure tone sound sources at frequencies below about 1500 Hz.

As noted above, the use of the ILD and ITD by the auditory system to localize sound sources is limited to particular frequency ranges. Furthermore, binaural hearing differences provide no information that would allow the auditory system to localize a sound source in the mid-sagittal plane (i.e., where the source is equidistant from each ear and located above, below, behind, or in front of the listener). Another acoustic phenomena utilized by the auditory system to overcome these limitations relates to the fact that sound waves coming from different directions in space are differently scattered by the listener's outer ears and head. This scattering causes an acoustical filtering of the signals eventually reaching the left and right ears, which filtering modifies the phases and amplitudes of the frequency components of the sound waves. The filtering thus constitutes a kind of spectral shaping that can be described by a directionally-dependent transfer function, referred to as the head-related transfer function (HRTF). The HRTF produces characteristic spectra for broad-band sounds emanating from different points in space that the brain learns to recognize and thus localize the source of the sound. Such HRTFs, which incorporate frequency-dependent amplitude and phase changes, also help in externalization and spatialization in general. If proper HRTFs are applied to both ears, proper ITD and ILD cues are also generated.

Generating Complex Sound Fields with HRTFs

As noted above, commercially available surround sound systems use multiple speakers surrounding a listener to generate more complex sound fields than can be obtained from systems having only one or two speakers. Surround sound recordings have separate surround sound output signals for driving each speaker of a surround sound system in order to generate the desired sound field. Technologies also exist for processing conventional two-channel stereo signals in order to synthesize separate surround sound output signals for driving each speaker of a surround sound system in a manner that approximates a specially made surround sound recording The Dolby Pro Logic II system is a commercially available example of this type of technology.

Whether derived from a surround sound recording or synthesized from stereo signals, surround sound output signals can be further processed using synthesized HRTFs to generate audio that can be directly coupled to the ear (e.g., by headphones) and give the impression to the listener that different sounds are coming from different locations. A commercially available example of this technology is Dolby Headphone. For example, a surround sound output signal intended to drive a left rear speaker can be filtered with an HRTF that is synthesized to represent the actual HRTF of a listener for sounds coming from the left rear direction. The result is a signal that can be used to drive a headphone or other device directly acoustically coupled to the ear and produce sound that seems to the listener to be coming from the left rear direction. Separate signals for each ear can be generated using an HRTF specific for either the right or left ear. Multiple surround sound output signals can be similarly filtered with separate HRTFs for each ear and for each direction associated with a particular surround sound output signal. The multiple filtered signals can then be summed together to form simulated surround signals that can be used to drive a pair of headphones and generate a complex sound field containing all of the spatial information of the original surround sound output signals.

Exemplary Hearing Aid Fitting System

A hearing aid fitting system as described herein may employ simulated surround sound signals generated using HRTFs as described above to generate complex sound fields that can be used as part of the fitting process. Due to problems with feedback and background noise, hearing aid wearers cannot usually use headphones worn over their hearing aids. Audio signals intended to drive headphones, however, can be used to drive any type of device directly acoustically coupled to the ear including hearing aids with similar results. As described above, the simulated surround sound signals may be transmitted via a wired or wireless connection to drive the speaker of a hearing aid. If the patient wears two hearing aids, both hearing aids may be driven in this manner. If only one hearing aid is worn by the patient, that hearing aid may be driven by one simulated surround signal, with the other simulated surround sound signal used to drive an another device such as a headphone or another hearing aid.

The use of complex sounds as generated from simulated surround sound signals applied to the hearing aids enables the user to experience a variety of sonic environments. The parameters of the hearing aid may then be adjusted in accordance with the subjective preferences of the hearing aid wearer. Hearing aid testing with sounds encoded with spatial information also permits an objective determination of whether the hearing aid wearer properly perceives the direction of a sound source. As described above, such perception depends upon being able to recognize an audio spectrum that has been filtered by an HRTF. The interpretation of acoustic spectra produced by the HRTF is thus dependent upon the ear properly responding to the different frequency components of the spectra. That, in turn, is dependent upon the hearing aid providing adequate compensation for the patient's hearing loss over the range of frequencies represented by the filtered spectrum. This provides another way of testing the frequency response of the hearing aid. Hearing aid parameters may be adjusted in a manner that allows the patient to correctly perceive sound sources located at different locations from the simulated surround signals applied to the hearing aids.

The sounds presented to the patient in the form of simulated surround sound may be derived from various sources such as music CDs or specially recorded or synthesized sounds. Audio samples may also be used that have been encoded such that when they are processed to generate simulated surround sound signals, a realistic surround audio environment is heard (e.g., a home environment or public place such as a restaurant). The hearing aid fitting system may also incorporate a 3D graphic system to create a more immersive environment for the hearing aid wearer being fitted. When such graphics are displayed in conjunction with the simulated surround sound, audiologists may find it easier to fit the hearing aids, better demonstrate features, and allow more realistic expectations to be set.

Additionally, in various embodiments, sounds presented to the patient include sounds pre-recorded using the hearing assistance device. In various embodiments, the pre-recorded sound includes sounds recorded using a microphone positioned inside a user's ear canal. In various embodiments, the pre-recorded sound includes sounds recorded using a microphone positioned outside a user's ear canal. In various embodiments, the pre-recorded sound includes sounds recorded using a combination of microphones positioned both inside and outside the user's ear canal. Other sounds and sound sources may be used without departing from the scope of the present subject matter. The pre-recorded sounds, or statistics thereof, are subsequently downloaded to a fitting system according to the present subject matter and used to assist in fitting a user's hearing assistance system when played backed in simulated surround sound format.

FIGS. 1 through 5 depict examples of signal processing systems that can be used to generate the simulated surround sound signals as described above. In these examples, five surround sound signals are generated and used to create the simulated surround sound signals for driving the hearing aids. Such systems could implemented in a personal computer (PC), where the audiologist selects any stereo sources and the software system creates simulated surround sound signals that will create a virtual surround sound environment when listened to through hearing aids. Alternatively, a small hardware processor can be attached to the PC sound card output that creates multiple surround sound channels, applies the HRTFs in real-time, and then transmits the simulated surround sound signals to the hearing aids via a wired or wireless connection. The HRTFs used in virtualizing the five surround sound channels may be generic ones, such as measured on a KEMAR. HRTFs may also be estimated by using a small number of measurements of the person's pinna. HRTFs could also be selected from a small set of HRTFs subjectively, where the subject listens to sounds through several HRTF sets and selects the one that sounds most realistic.

FIG. 1 illustrates a basic system that includes a signal processor 102 for processing left and right stereo signals SL and SR in order to produce left and right simulated surround sound output signals LO and RO that can be used to drive left and right corrective hearing assistance devices 104 and 106. As the term is used herein, a corrective hearing assist device is any device that provides compensation for hearing loss by means of frequency selective amplification. Such devices would include, for example, behind-the-ear, in-the-ear, in-the-canal, and completely-in-the-canal hearing aids. The output signals LO and RO may be transferred to the direct audio input of a hearing assistance device by means of a wired or wireless connection. In the latter case, the hearing assistance device is equipped with a wireless receiver for receiving radio-frequency signals. The frequency selective amplification of the corrective hearing assistance devices, as well as well other parameters, may be adjusted by means of parameter adjustment inputs 104*a* and 106*a* for each of the devices 104 and 106, respectively. The signal processor 102 optionally has an environment selection input 101 for selecting particular acoustic environments. Some examples of acoustic environments include, but are not limited to, a classroom with moderate reverberation and a living room with low reverberation, a restaurant with high reverberation. The signal processor 102 also optionally has an HRTF selection input 103 for selecting particular sets of HRTFs used to generate the simulated surround sound output signals. Some examples of HRTFs to select include, but are not limited to, those measured on a KEMAR manakin, those specific to and measured on the patient and those measured on a set of people whose HRTFs collectively span the expected HRTFs measured on any individual.

Figure 2:
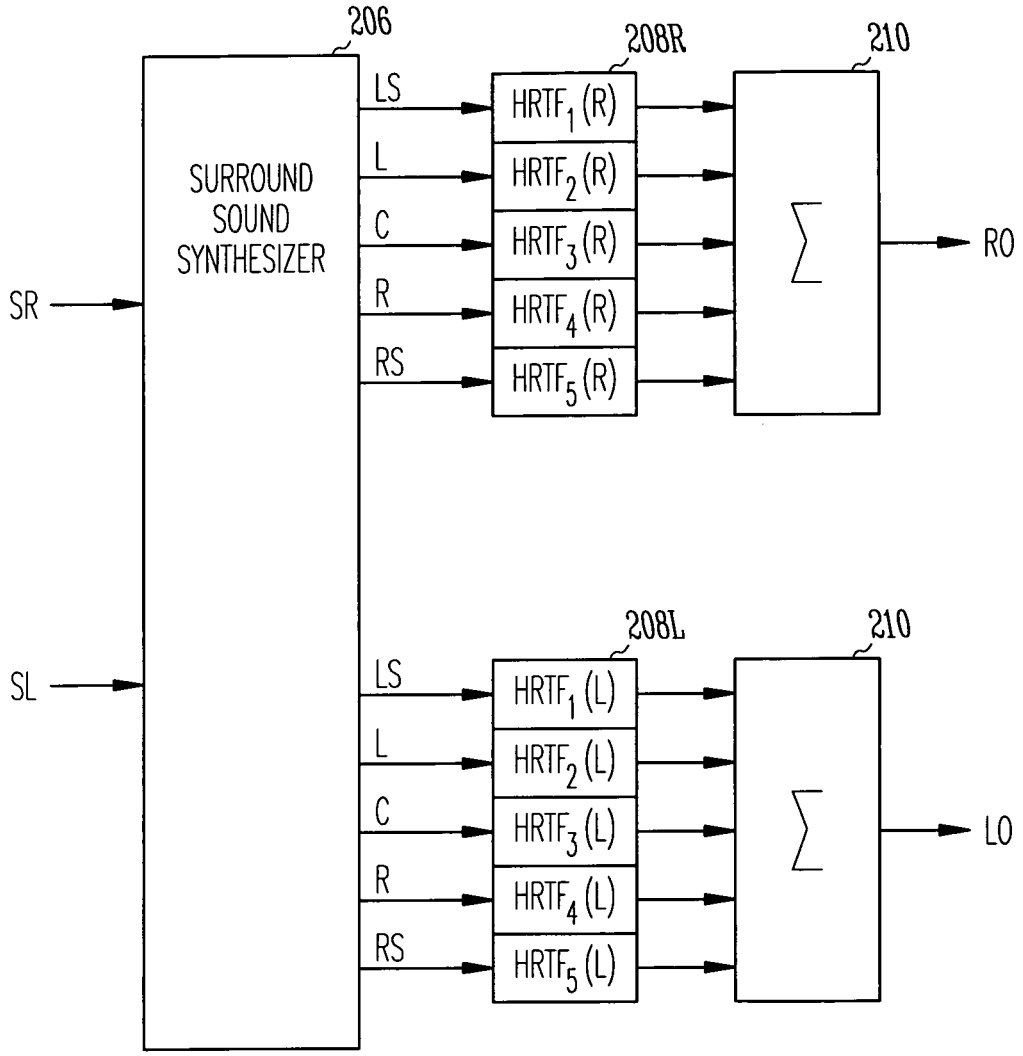
FIG. 2 shows a particular embodiment of the signal processor that includes a surround sound synthesizer for synthesizing the surround sound signals from the left and right stereo signals according to the present subject matter.

FIG. 2 shows a particular embodiment of the signal processor 102 that includes a surround sound synthesizer 206 for synthesizing the surround sound signals LS, L, C, R, and RS from the left and right stereo signals SL and SR. In one embodiment, these signals are provided using techniques known to those in the art (e.g., Dolby Pro-Logic Decoder). The signal may also be generated using other sound process methods. The surround sound signals LS, L, C, R, and RS thus produced would create a surround sound environment by driving speakers located at the left rear, left front, center front, right front, and right rear of the listener, respectively. Rather than driving such speakers, however, the surround sound signals are further processed by banks of head-related transfer functions to generate output signals RO and LO that can be used to drive devices providing a single acoustic output to each ear (i.e., corrective hearing assistance devices) and still generate the surround sound effect. FIG. 2 shows two filter banks 208R and 208L that process the surround sound signals for the right and left ears, respectively, with head-related transfer functions. The filter bank 208R processes the surround sound signals LS, L, C, R, and RS with head-related transfer functions $HRTF_1(R)$ through $HRTF_5(R)$, respectively, for the right ear. The filter bank 208L similarly processes the surround sound signals LS, L, C, R, and RS with head-related transfer functions $HRTF_1(L)$ through $HRTF_5(L)$, respectively, for the left ear. Each of the head-related transfer functions is a function of head anatomy (either the patient's individual anatomy or that of a model), the type of hearing assistance device to which to output signals RO and LO are to be input (e.g., behind-the-ear, in-the-ear, in-the-canal, and completely-in-the-canal hearing aids), and the azimuthal direction of the sound source to be simulated by it (i.e., the particular surround sound signal). In most cases, the head-related transfer functions $HRTF_1(R)$ through $HRTF_5(R)$ and the functions $HRTF_1(L)$ through $HRTF_5(L)$ will be symmetrical but in certain instances may be asymmetrical. The outputs of each of the filter banks 208R and 208L are summed by summers 210 to produce the output signals RO and LO, respectively, used to drive the right and left hearing assistance devices.

In an exemplary embodiment, the surround sound synthesizer and filter banks are implemented by means of a memory adapted to store at least one head-related transfer function for each angle of reception to be synthesized and a processor connected to the memory and to a plurality of inputs including a stereo right (SR) input and a stereo left (SL) input. The processor is adapted to convert the SR and SL inputs into left surround (LS), left (L), center (C), right (R) and right surround (RS) signals, and further adapted to generate processed versions for each of the LS, L, C, R, and RS signals by application of a head-related transfer function at an individual angle of reception for each of the LS, L, C, R, and RS signals. The processor is further adapted to mix the processed versions of the LS, L, C, R, and RS signals to produce a right output signal (RO) and a left output signal (LO) for a first hearing assistance device and a second hearing assistance device, respectively. The output signals RO and LO may be immediately transferred to the hearing assistance devices as they are generated or may be stored in memory for later transfer to the hearing assistance devices.

Figure 3:
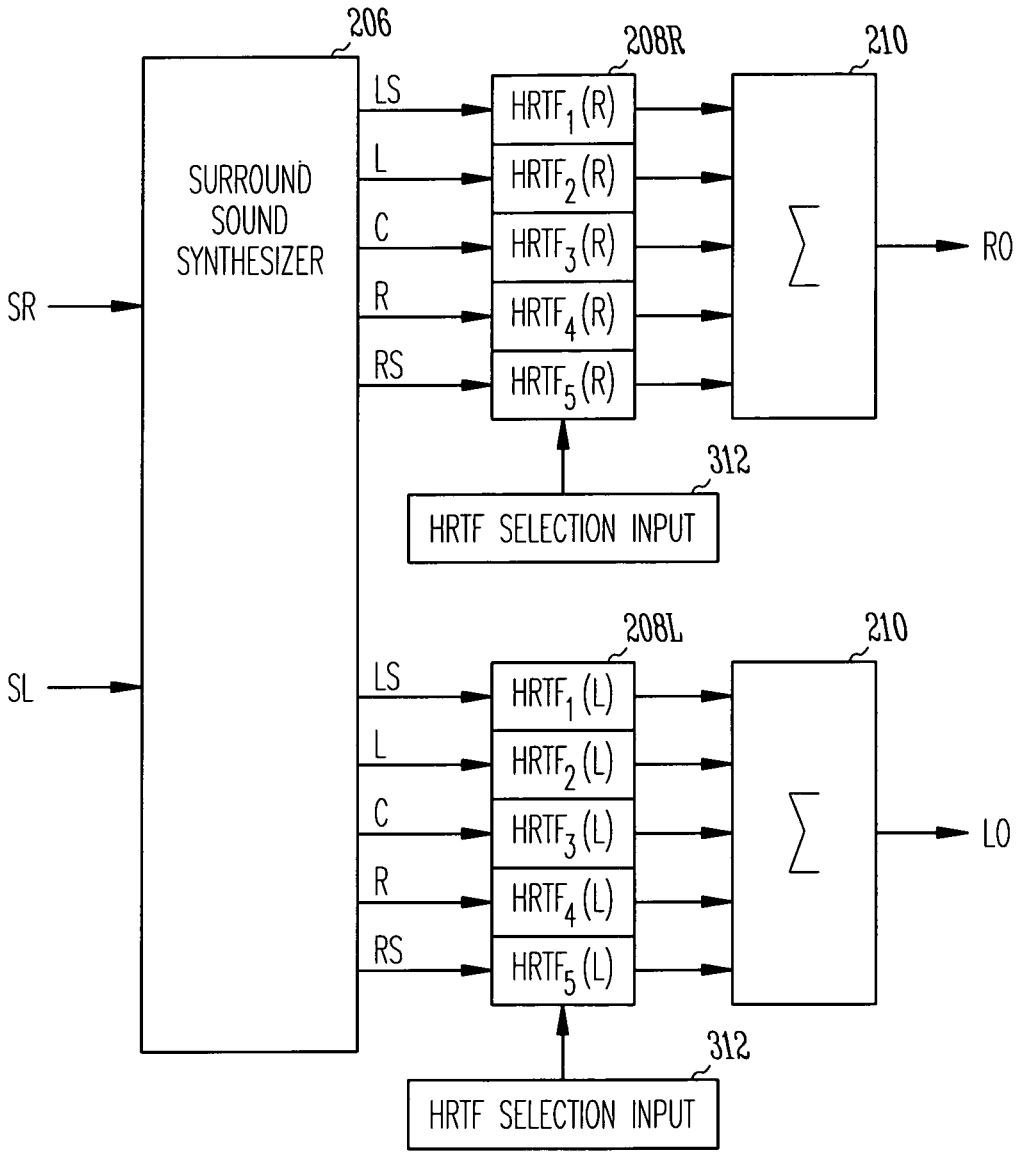
FIG. 3 shows one embodiment of the system shown in FIG. 2 to which has been added an HRTF selection input for each of the filter bank according to the present subject matter.

FIG. 3 shows another embodiment of the system shown in FIG. 2 to which has been added an HRTF selection input 312 for each of the filter banks 208R and 208L. This added functionality allows a user to select between different sets of head-related transfer functions for each ear. For example, the user may select between individualized or actual HRTFs and generic HRTFs or may adjust the individualized HRTFs in accordance with the subjective sensations reported by the patient. Also, different sets of head-related transfer functions may be used during the hearing aid fitting process to produce different effects and further test the frequency response of the hearing aid. For example, sets of HRTFs that simulate sound direction that varies with elevation angle in addition to azimuth angle may be employed.

Figure 4:
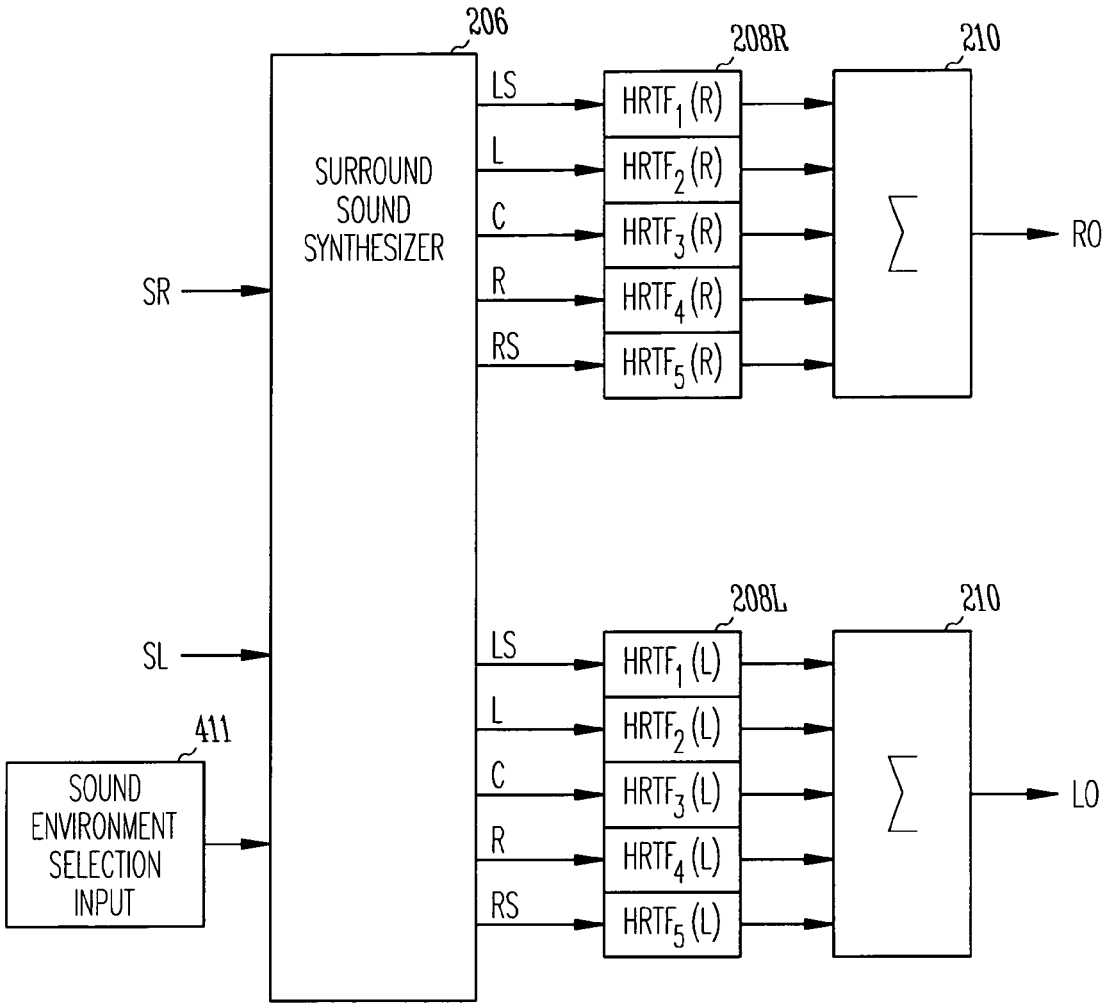
FIG. 4 shows one embodiment of the system shown in FIG. 2 to which has been added a sound environment selection input to the surround sound synthesizer for selecting between different acoustic environments used to synthesize the surround sound signals from the stereo signals according to the present subject matter.

FIG. 4 shows another embodiment of the system shown in FIG. 2 to which has been added a sound environment selection input 411 to the surround sound synthesizer for selecting between different acoustic environments used to synthesize the surround sound signals from the stereo signals SL and SR. Employing different simulated acoustic environments with different reverberation characteristics adds complexity to the sound field produced by the output signals RO and LO that can be useful for testing the frequency response of the hearing aid. Presenting different acoustic environments to the patient also allows finer adjustment of hearing aid parameters in accordance with individual patient preferences.

Figure 5:
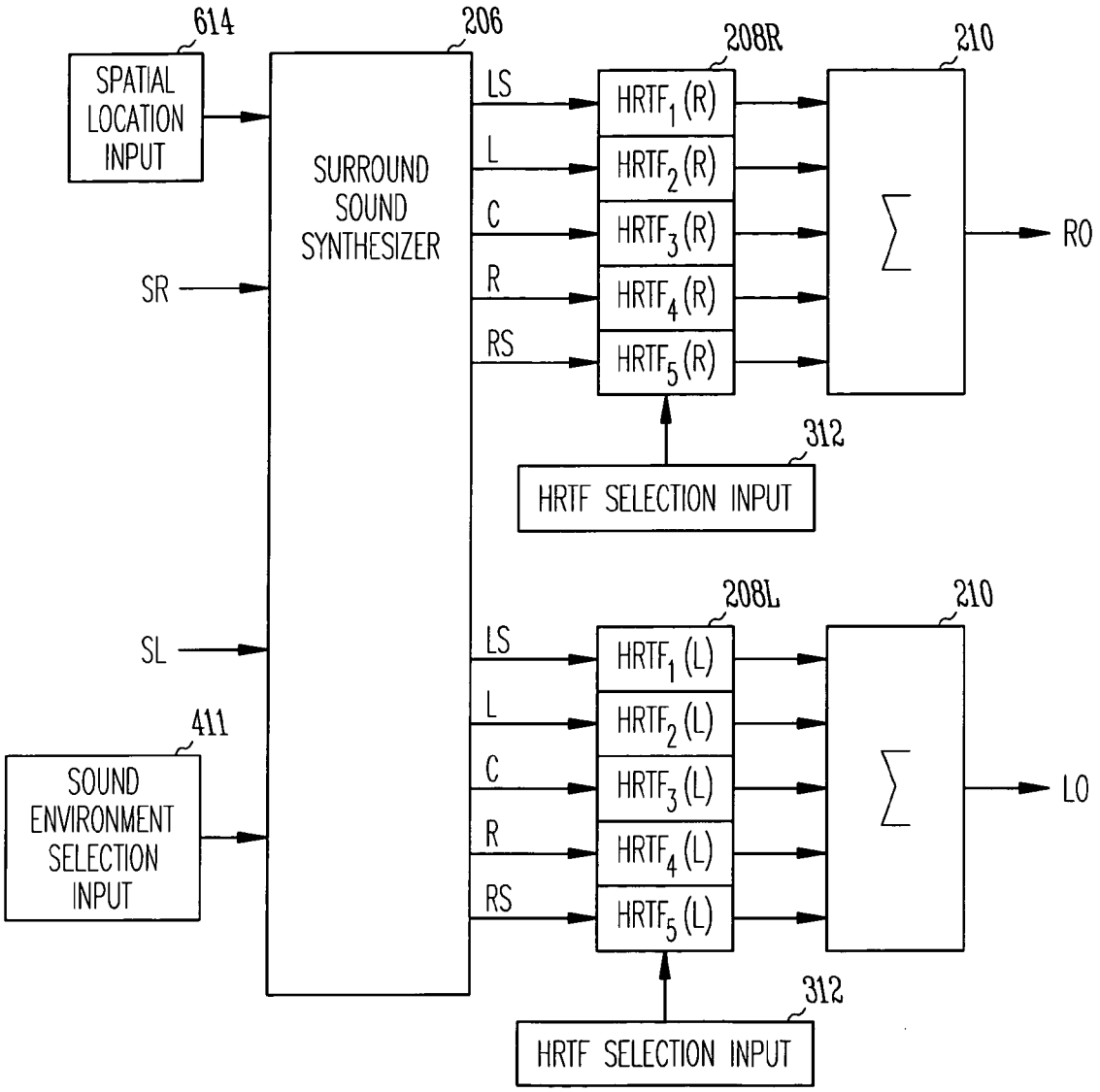
FIG. 5 shows one embodiment of a system that includes a spatial location input for the surround sound synthesizer in addition to an HRTF selection input for each of the filter banks and a sound environment selection input according to the present subject matter.

In another embodiment of the system shown in FIG. 2, an input is provided to the surround sound synthesizer 206 that allows a user to adjust the spatial locations simulated by the surround sound signals. FIG. 5 shows an example of a system that includes a spatial location input 614 for the surround sound synthesizer 206 in addition to an HRTF selection input 312 for each of the filter banks and a sound environment selection input 411. The spatial location input 614 allows the surround sound signals generated by the surround sound synthesizer to be adjusted in a manner that varies the locations of the surround sound signals that are subsequently processed with the HRTFs to produce the output signals RO and LO. Spatial locations of the surround sound signals may be varied in discrete steps or varied dynamically to produce a panning effect. Varying the spatial location of sound sources in the simulated sound field allows further testing and adjustment of the hearing assistance device's frequency response in accordance with objective criteria and/or individual patient preferences.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. A method, comprising:

recording signals from a sound environment using a hearing assistance device including one or both of a microphone positioned inside a user's ear canal and a microphone positioned outside of the user's ear canal, the signals having a stereo right (SR) signal and a stereo left (SL) signal;

processing the SR and SL signals to produce left surround (LS), left (L), center (C), right (R) and right surround (RS) signals using a processor;

generating a processed version for each of the LS, L, C, R, and RS signals by application of a head-related transfer function at an individual angle of reception for each of the LS, L, C, R, and RS signals using the processor;

mixing the processed version of the LS, L, C, R, and RS signals to produce one or both of a right output signal (RO) and a left output signal (LO) using the processor;

transmitting the RO signal directly from the processor to a right hearing aid, transmitting the LO signal directly from the processor to a left hearing aid, or transmitting the RO signal directly from the processor to the right hearing aid and the LO signal directly from the processor to the left hearing aid; and fitting the right hearing aid, the left hearing aid, or both the right and left hearing aids using the RO and LO signals.

2. The method of claim 1, comprising programming a head-related transfer function in one or both of the right hearing aid and the left hearing aid.

3. The method of claim 2, comprising using the direct audio inputs of the right hearing aid and the left hearing aid.

4. The method of claim 1, wherein the processing further comprises using a generic head-related transfer function.

5. The method of claim 1, wherein the processing further comprises:

measuring at least a portion of an actual head-related transfer function; and applying the actual head-related transfer function to generate the processed version for each of the LS, L, C, R, and RS signals.

6. The method of claim 5, wherein measuring at least the portion of the actual head-related transfer function comprises measuring the at least the portion of the actual head-related transfer function on an individual patient.

7. The method of claim 5, wherein measuring at least the portion of the actual head-related transfer function comprises measuring the at least the portion of the actual head-related transfer function on a patient population.

8. The method of claim 1, wherein the processing further comprises:

playing sounds through a plurality of head-related transfer function sets;

receiving a selected head-related transfer function set of the plurality of head-related transfer function sets; and applying the selected head-related transfer function set to generate the processed version for each of the LS, L, C, R, and RS signals.

9. The method of claim 8, wherein playing sounds comprises playing the sounds through the plurality of head-related transfer function sets to a subject, and receiving the selected head-related transfer function set comprises receiving a head-related transfer function set selected by the subject from the plurality of head-related transfer function sets.

10. The method of claim 1, wherein the processing further comprises using a Dolby Pro-Logic 2 process.

11. The method of claim 1, further comprising:

generating a plurality of pre-recorded RO and LO signals; and storing the plurality of pre-recorded RO and LO signals.

12. The method of claim 1, wherein the head-related transfer function is processed for a wearer of completely-in-the-canal hearing aids.

13. The method of claim 1, wherein the head-related transfer function is processed for a wearer of in-the-canal hearing aids.

14. The method of claim 1, wherein the head-related transfer function is processed for a wearer of behind-the-ear hearing aids.

15. The method of claim 1, wherein the head-related transfer function is processed for a wearer of in-the-ear hearing aids.

16. The method of claim 1, further comprising receiving spatial location input for adjusting spatial locations of sound sources simulated by the LS, L, C, R, and RS signals, and processing the SR and SL signals to produce the LS, L, C, R, and RS signals comprises processing the SR and SL signals using the spatial location input to produce the LS, L, C, R. and RS signals that simulate the adjusted spatial locations of sound sources.

17. The method of claim 1, further comprising pre-recording the signals from the sound environment for use in the processing.

18. The method of claim 17, wherein pre-recording the signals comprises pre-recording sound samples encoded for simulating realistic surround audio environment.

19. The method of claim 17, wherein pre-recording the signals comprises recording the signals using a hearing assistance device.

20. The method of claim 19, wherein pre-recording the signals comprises recording the signals using a combination of microphones positioned both inside and outside a user's ear canal.

21. The method of claim 17, further comprising displaying 3D graphics in conjunction with playing the RO and LO signals during the fitting of the right and left hearing aids to create an immersive environment.

22. An apparatus for fitting either or both of a first hearing and a second hearing aid, comprising:

a memory configured to store at least one head-related transfer function;

a plurality of inputs configured to receive from a hearing assistance device signals recorded from a sound environment using one or both of a microphone positioned inside a user's ear canal and a microphone positioned outside of the user's ear canal, the signals including a stereo right (SR) signal and a stereo left (SL) signal;

a processor connected to the memory and to the plurality of inputs, the processor configured to convert the SR and SL signals into left surround (LS), left (L), center (C), right (R) and right surround (RS) signals, the processor further configured to generate a processed version for each of the LS, L, C, R, and RS signals by application of the head-related transfer function at an individual angle of reception for each of the LS, L, C, R, and RS signals;

the processor configured to mix the processed version of the LS, L, C, R, and RS signals to produce a fight output (RO) signal and a left output (LO) signal for use in the fitting of the either or both of the first and second hearing aids; and a direct connection between the processor and either or both of the first and second hearing aids, the direct connection configured to transmit either or both of the RO and LO signals to the either or both of the first and second hearing aids.

23. The apparatus of claim 22, further comprising a wireless transmitter configured to transmit the either or both of the RO and LO signals to the either or both of the first and second hearing aids through the direct connection.

24. The apparatus of claim 22, further comprising an output for wired connections of the direct connection between the processor and the either or both of the first and second hearing aids.

25. The apparatus of claim 22, further comprising a plurality of RO and LO signals produced for different sound environments stored in the memory.

26. The apparatus of claim 22, further comprising a plurality of RO and LO signals produced for different head related transfer functions stored in the memory.

27. The apparatus of claim 22, further comprising a plurality of RO and LO signals produced for different sound environments and different head related transfer functions stored in the memory.

28. The apparatus of claim 22, further comprising an input for selection of one of a plurality of sound environments.

29. The apparatus of claim 28, wherein the input for selection of one of a plurality of sound environments comprises an input for selection of acoustic environments with different levels of reverberation.

30. The apparatus of claim 29, further comprising an input for selection of one of a plurality of sets of head-related transfer functions.

31. The apparatus of claim 30, wherein the input for selection of one of the plurality of sets of head-related transfer functions comprises an input for selection of one of at least a generic set of head-related transfer functions, a set of head-related transfer functions measured on an individual patient, and a set of head-related transfer functions measured on a patient population.

32. The apparatus of claim 30, wherein the input for selection of one of the plurality of sets of head-related transfer functions comprises an input for selection of one of sets of head-related transfer functions that simulate various sound directions.

33. The apparatus of claim 22, further comprising an input for selection of one of a plurality of sets of head-related transfer functions.

34. The apparatus of claim 22, further comprising a first input for selection of one of a plurality of sets of head-related transfer functions and a second input for selection of one of a plurality of sound environments.

35. The apparatus of claim 22, wherein the head-related transfer function is processed for a wearer of completely-in-the-canal hearing aids.

36. The apparatus of claim 22, wherein the head-related transfer function is processed for a wearer of in-the-canal hearing aids.

37. The apparatus of claim 22, wherein the head-related transfer function is processed for a wearer of behind-the-ear hearing aids.

38. The apparatus of claim 22, wherein the head-related transfer function is processed for a wearer of in-the-ear hearing aids.

39. The apparatus of claim 22, wherein the plurality of inputs further comprises a spatial location input configured to allow for adjustment of spatial locations of sound sources simulated by the LS, L, C, R, and RS signals, and the processor is configured to convert the SR and SL inputs into the LS, L, C, R, and RS signals using the adjustment such that the LS, L, C, R, and RS signals simulate the adjusted spatial locations of sound sources.

40. The apparatus of claim 22, further comprising microphones configured to pre-record sounds including the SL and SR signals.

41. The apparatus of claim 40, further comprising a 3D graphic system configured to display 3D graphics during the fitting of the right and left hearing aids to create an immersive environment.

* * * * *

UNITED STATES PATENT AND TRADEMARK OFFICE

CERTIFICATE OF CORRECTION

PATENT NO. : 9,031,242 B2
APPLICATION NO. : 11/935935
DATED : May 12, 2015
INVENTOR(S) : Edwards et al.

It is certified that error appears in the above-identified patent and that said Letters Patent is hereby corrected as shown below:

In the Claims

In column 11, line 7, in Claim 22, delete “fight” and insert --right--, therefor Signed and Sealed this
Second Day of February, 2016

Michelle K. Lee

Michelle K. Lee
*Director of the United States Patent and Trademark Office*